US011920207B2

(12) United States Patent
Pipard et al.

(10) Patent No.: US 11,920,207 B2
(45) **Date of Patent: *Mar. 5, 2024**

(54) COLD ROLLED STEEL SHEET AND A METHOD OF MANUFACTURING THEREOF

(71) Applicant: ArcelorMittal, Luxembourg (LU)

(72) Inventors: Jean-Marc Pipard, Vaux (FR); Artem Arlazarov, Blenod les Pont A Mousson (FR)

(73) Assignee: ArcelorMittal, Luxembourg (LU)

( * ) Notice: Subject to any disclaimer, the term of this patent is extended or adjusted under 35 U.S.C. 154(b) by 18 days.

This patent is subject to a terminal disclaimer.

(21) Appl. No.: 16/761,417

(22) PCT Filed: Nov. 5, 2018

(86) PCT No.: PCT/IB2018/058666
§ 371 (c)(1),
(2) Date: May 4, 2020

(87) PCT Pub. No.: WO2019/092578
PCT Pub. Date: May 16, 2019

(65) Prior Publication Data

US 2021/0002740 A1 Jan. 7, 2021

(30) Foreign Application Priority Data

Nov. 10, 2017 (WO) ..... PCT/IB2017/057039

(51) Int. Cl.

| | |
|---|---|
| ***C21D 9/46*** | (2006.01) |
| ***B21B 3/02*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |

(Continued)

(52) U.S. Cl.

CPC ..... *C21D 9/46* (2013.01); *B21B 3/02* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0247* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/008* (2013.01)

(58) Field of Classification Search

CPC ..... B21B 3/02; C21D 2211/001; C21D 2211/002; C21D 2211/008; C21D 6/004; C21D 6/005; C21D 6/008; C21D 8/0205; C21D 8/0226; C21D 8/0236; C21D 8/0247; C21D 8/0263; C21D 8/0268; C21D 8/0273; C21D 9/46; C22C 38/00; C22C 38/001; C22C 38/002; C22C 38/02; C22C 38/04; C22C 38/06; C22C 38/42; C22C 38/44; C22C 38/46; C22C 38/48; C22C 38/50; C22C 38/54; C22C 38/58

See application file for complete search history.

(56) References Cited

U.S. PATENT DOCUMENTS

| | | | | |
|---|---|---|---|---|
| 8,480,819 | B2 | 7/2013 | Futamura et al. | |
| 2001/0015245 | A1 | 8/2001 | Eberle et al. | |
| 2011/0146852 | A1 | 6/2011 | Matsuda et al. | |
| 2014/0096876 | A1 | 4/2014 | Matsuda et al. | |
| 2014/0242416 | A1 | 8/2014 | Matsuda et al. | |
| 2016/0177414 | A1* | 6/2016 | Takashima ..... | C21D 6/004 148/330 |

(Continued)

FOREIGN PATENT DOCUMENTS

| | | | |
|---|---|---|---|
| CN | 101928875 | A | 12/2010 |
| CN | 104532129 | A | 4/2015 |

(Continued)

OTHER PUBLICATIONS

International Search Report of PCT/IB2018/058666, dated Jan. 22, 2019.

*Primary Examiner* — Jenny R Wu
(74) *Attorney, Agent, or Firm* — Davidson, Davidson & Kappel, LLC

(57) ABSTRACT

A cold rolled heat treated steel sheet having a composition with the following elements, expressed in percentage by weight 0.1%≤Carbon≤0.5%, 1%≤Manganese≤3.4%, 0.5%≤Silicon≤2.5%, 0.03%≤Aluminum≤1.5%, 0%≤Sulfur≤0.003%, 0.002%≤Phosphorus≤0.02%, 0%≤Nitrogen≤0.01% and can contain one or more of the following optional elements 0.05%≤Chromium≤1%, 0.001%≤Molybdenum≤0.5%, 0.001%≤Niobium≤0.1%, 0.001%≤Titanium≤0.1%, 0.01%≤Copper≤2%, 0.01%≤Nickel≤3%, 0.0001%≤Calcium≤0.005%, 0%≤Vanadium≤0.1%, 0%≤Boron≤0.003%, 0%≤Cerium≤0.1%, 0%≤Magnesium≤0.010%, 0%≤Zirconium≤0.010%, the remainder composition being composed of iron and unavoidable impurities caused by processing, the microstructure of the steel sheet having in area fraction, 10 to 30% Residual Austenite, 50 to 85% Bainite, 1 to 20% Quenched Martensite, and less than 30% Tempered Martensite.

22 Claims, No Drawings

(51) Int. Cl.

| | |
|---|---|
| ***C22C 38/50*** | (2006.01) |
| ***C22C 38/54*** | (2006.01) |
| ***C22C 38/58*** | (2006.01) |

(56) References Cited

U.S. PATENT DOCUMENTS

| | | | | |
|---|---|---|---|---|
| 2017/0101695 | A1 | 4/2017 | Arlazarov et al. | |
| 2019/0003009 | A1 * | 1/2019 | Kawata | C22C 38/04 |
| 2019/0040482 | A1 | 2/2019 | Kimata et al. | |
| 2019/0040483 | A1 | 2/2019 | Kimata et al. | |
| 2020/0316807 | A1 | 10/2020 | Fojer et al. | |

FOREIGN PATENT DOCUMENTS

| | | | | |
|---|---|---|---|---|
| CN | 106661653 | A | | 5/2017 |
| EP | 1486574 | | | 12/2004 |
| EP | 2762582 | | | 8/2014 |
| EP | 3009527 | | | 4/2016 |
| EP | 3101147 | | | 12/2016 |
| EP | 3128023 | | | 2/2017 |
| EP | 3144406 | | | 3/2017 |
| JP | 2004190050 | A | * | 7/2004 |
| JP | 2008038247 | A | | 2/2008 |
| JP | 2010090475 | A | | 4/2010 |
| JP | 2010285636 | A | | 12/2010 |
| JP | 2011184758 | A | | 9/2011 |
| JP | 2013072101 | | | 4/2013 |
| JP | 2013163827 | A | | 8/2013 |
| JP | 2017145466 | A | * | 8/2017 |
| KR | 100608555 | B1 | | 8/2006 |
| KR | 20110039395 | | | 4/2011 |
| KR | 20110089077 | A | | 8/2011 |
| WO | WO2013051238 | A1 | | 4/2013 |
| WO | WO2015177615 | | | 11/2015 |
| WO | WO2017138503 | A1 | | 8/2017 |
| WO | WO2017138504 | A1 | | 8/2017 |

* cited by examiner

COLD ROLLED STEEL SHEET AND A METHOD OF MANUFACTURING THEREOF

The present invention relates to cold rolled and heat treated steel sheet which is suitable for use as a steel sheet for automobiles.

BACKGROUND

Automotive parts are required to satisfy two inconsistent requirements, namely ease of forming and strength, but in recent years a third requirement of improvement in fuel consumption by reducing weight is also required in view of global environment concerns. Thus, now automotive parts must be made of material having high formability, in order to meet the criteria of ease of fit in the intricate automobile assembly, and at same time have to improve strength for vehicle crashworthiness and durability while reducing weight of vehicle to improve fuel efficiency.

Therefore, intense research and development endeavors have been undertaken to reduce the amount of material utilized in car by increasing the strength of material. Conversely, an increase in strength of steel sheets decreases formability, and thus development of materials having both high strength and high formability is necessitated.

Earlier research and developments in the field of high strength and high formability steel sheets have resulted in several methods for producing high strength and high formability steel sheets, some of which are enumerated herein for conclusive appreciation of the present invention:

EP3144406 discloses a high-strength cold-rolled steel sheet having excellent ductility that comprises by wt. %, Carbon (C): 0.1% to 0.3%, Silicon (Si): 0.1% to 2.0%, Aluminum (Al): 0.005% to 1.5%, Manganese (Mn): 1.5% to 3.0%, Phosphorus (P): or less (excluding 0%), Sulfur (S): 0.015% or less (excluding 0%), Nitrogen (N): or less (excluding 0%), and a remainder of Iron (Fe) and inevitable impurities wherein a sum of Silicon and Aluminum (Si+Al) (wt %) satisfies 1.0% or more, and wherein a microstructure comprises: by area fraction, 5% or less of Polygonal Ferrite having a minor axis to major axis ratio of 0.4 or greater, 70% or less (excluding 0%) of Acicular Ferrite having a minor axis to major axis ratio of 0.4 or less, 25% or less (excluding 0%) of acicular Retained Austenite, and a remainder of Martensite. Further EP3144406 envisage for a high strength steel with a tensile strength of 780 MPa or more.

EP3128023 mentions a high-strength cold-rolled steel sheet having excellent elongation, hole expandability, and delayed fracture resistance and high yield ratio, and a method for producing the steel sheet. A high-yield-ratio, high-strength cold-rolled steel sheet has a composition containing, in terms of % by mass, C: 0.13% to 0.25%, Si: 1.2% to 2.2%, Mn: 2.0% to 3.2%, P: 0.08% or less, S: 0.005% or less, Al: 0.01% to N: 0.008% or less, Ti: 0.055% to 0.130%, and the balance being Fe and unavoidable impurities. The steel sheet has a microstructure that contains 2% to 15% of ferrite having an average crystal grain diameter of 2 μm or less in terms of volume fraction, 5 to 20% of retained austenite having an average crystal grain diameter of 0.3 to 2.0 μm in terms of volume fraction, 10% or less (including 0%) of martensite having an average grain diameter of 2 μm or less in terms of volume fraction, and the balance being bainite and tempered martensite, and the bainite and the tempered martensite having an average crystal grain diameter of 5 μm or less.

EP3009527 provides a high-strength cold-rolled steel sheet having excellent elongation, excellent stretch flangeability, and high yield ratio and a method for manufacturing the same. The high-strength cold-rolled steel sheet has a composition and a microstructure. The composition contains 0.15% to 0.27% C, 0.8% to 2.4% Si, 2.3% to 3.5% Mn, 0.08% or less P, 0.005% or less S, 0.01% to 0.08% Al, and 0.010% or less N on a mass basis, the remainder being Fe and inevitable impurities. The microstructure comprises: ferrite having an average grain size of 5 μm or less and a volume fraction of 3% to 20%, retained austenite having a volume fraction of 5% to 20%, and martensite having a volume fraction of 5% to 20%, the remainder being bainite and/or tempered martensite. The total number of retained austenite with a grain size of 2 μm or less, martensite with a grain size of 2 μm or less, or a mixed phase thereof is 150 or more per 2,000 μm 2 of a thickness cross section parallel to the rolling direction of the steel sheet.

Another patent application WO2015/177615 also describes a double-annealed steel sheet, the composition of which comprises, the contents being expressed as weight percentage, 0.20%≤C≤0.40%, 0.8%≤Mn≤1.4%, 1.60%≤Si≤3.00%, 0.015%≤Nb≤0.150%, Al≤0.1%, Cr≤1.0%, S≤0.006%, P≤0.030%, Ti≤0.05%, V≤0.05%, B≤0.003%, N≤0.01%, the rest of the composition consisting of iron and unavoidable impurities resulting from the production, the microstructure consisting, in surface area proportions, of 10% to 30% of Residual Austenite, of 30% to 60% of Annealed Martensite, of 5% to 30% of Bainite, of 10% to 30% of Quenched Martensite and of less than 10% of Ferrite. Further WO2015/177615 envisages a strength of 980 MPa or more.

SUMMARY OF THE INVENTION

An object of the present invention is to solve these problems by making available cold-rolled steel sheets that simultaneously have:

- an ultimate tensile strength greater than or equal to 1100 MPa and preferably above 1180 MPa,
- a total elongation greater than or equal to 14.0% and preferably above 15%

In a preferred embodiment, the steel sheets according to the invention may also a yield strength to tensile strength ratio of 0.65 or more Preferably, such steel can also have a good suitability for forming, in particular for rolling with good weldability and coatability.

The present invention provides a cold rolled heat treated steel sheet having a composition comprising of the following elements, expressed in percentage by weight:

0.1%≤Carbon≤0.5%
1%≤Manganese≤3.4%
0.5%≤Silicon≤2.5%
0.03%≤Aluminum≤1.5%
0%≤Sulfur≤0.003%.
0.002%≤Phosphorus≤0.02%
0%≤Nitrogen≤0.01% and can contain one or more of the following optional elements 0.05%≤Chromium≤1%
0.001%≤Molybdenum≤0.5%
0.001%≤Niobium≤0.1%
0.001%≤Titanium≤0.1%
0.01%≤Copper≤2%
0.01%≤Nickel≤3%
0.0001%≤Calcium≤0.005%
0%≤Vanadium≤0.1%
0%≤Boron≤0.003%

0%≤Ceriums≤0.1%

0%≤Magnesium≤0.010%

0%≤Zirconium≤0.010% the remainder composition being composed of iron and unavoidable impurities caused by processing, the microstructure of said steel sheet comprising in area fraction, 10 to 30% Residual Austenite, 50 to 85% Bainite, 1 to 20% Quenched Martensite, and less than 30% Tempered Martensite.

Another alternate or additional object of the present invention is to make available a method for the manufacturing of these sheets that is compatible with conventional industrial applications while being robust towards manufacturing parameters shifts.

The present invention provides a method of production of a cold rolled heat treated steel sheet comprising the following successive steps:

providing the steel composition;

reheating said semi-finished product to a temperature between 1200° C. and 1280° C.;

rolling the said semi-finished product in the austenitic range wherein the hot rolling finishing temperature shall be above Ac3 to obtain a hot rolled steel sheet;

cooling the sheet at a cooling rate above 30° C./s to a coiling temperature which is below 600° C.; and coiling the said hot rolled sheet;

cooling the said hot rolled sheet to room temperature;

optionally performing scale removal process on said hot rolled steel sheet;

optionally annealing may be performed on hot rolled steel sheet at temperature between 400° C. and 750° C.;

optionally performing scale removal process on said hot rolled steel sheet;

cold rolling the said hot rolled steel sheet with a reduction rate between and 90% to obtain a cold rolled steel sheet;

then heating the said cold rolled steel sheet at a rate greater than 3° C./s to a soaking temperature between Ac3 and Ac3+100° C. where it is held during 10 to 500 seconds;

then cooling the sheet at a rate greater than 20° C./s to a temperature below 500° C.;

then cooling the said annealed cold rolled steel sheet to room temperature;

optionally performing tempering the said annealed steel sheet between 120° C. and 250° C.;

then heating the said annealed cold rolled steel sheet at a rate greater than 3° C./s to a soaking temperature between Ac3 and Ac3+100° C. where it is held during 10 to 500 seconds;

then cooling the sheet at a rate greater than 20° C./s to a temperature range between $Tc_{max}$ and $Tc_{min}$ wherein:

$$Tc_{max}=565-601*(1-Exp(-0.868*C))-34*Mn-13*Si-Cr+13*Al-361*Nb$$

$$Tc_{min}=535-601*(1-Exp(-0.868*C))-34*Mn-13*Si-Cr+13*Al-361*Nb$$

then the said annealed cold rolled steel sheet is brought to holding temperature range between 350° C. and 550° C. for a time period between and 500 seconds and then cooling the said annealed cold rolled steel sheet to room temperature with a cooling rate 1° C./s to room temperature to obtain cold rolled heat treated steel sheet;

the cold rolled heat treated steel sheet optionally may be coated.

DETAILED DESCRIPTION

The above object and other advantages of the present invention will become more apparent by describing in detail the preferred embodiment of the present invention.

The cold rolled and heat treated steel sheet of the present invention may optionally be coated with zinc or zinc alloys, or with aluminum or aluminum alloys to improve its corrosion resistance.

Carbon is present in the steel between 0.10% and 0.5%. Carbon is an element necessary for increasing the strength of a steel sheet by producing a low-temperature transformation phase such as Martensite, further Carbon also plays a pivotal role in austenite stabilization hence a necessary element for securing Residual Austenite.

Manganese content of the steel of the present invention is between 1% and 3.4%. This element is gammagenous. The purpose of adding Manganese is essentially to obtain a structure that contains austenite and to impart strength to the steel. Manganese is an element which stabilizes Austenite to obtain Residual Austenite. An amount of at least about 1% by weight of Manganese has been found in order to provide the strength and hardenability of the steel sheet as well as to stabilize Austenite. Thus, a higher percentage of Manganese is preferred by presented invention such as 3.4%. But, when Manganese content is more than 3.4%, it produces adverse effects such as it retards transformation of Austenite to Bainite during the isothermal holding for Bainite transformation. In addition the Manganese content of above 3.4% also deteriorates the weldability of the present steel, hence, the ductility targets may not be achieved. The preferable range for Manganese is 1.2% and 2.3% and more preferable range is between 1.2% and 2.2%.

Silicon content of the steel of the present invention is between 0.5% and 2.5%. Silicon is a constituent that can retard the precipitation of carbides during overageing, therefore, due to the presence of Silicon, Carbon rich Austenite is stabilized at room temperature. Further, due to poor solubility of Silicon in carbide it effectively inhibit or retard the formation of carbides, hence, also promote the formation of low density carbides in Bainitic structure which is sought as per the present invention to impart steel with its essential features. However, disproportionate content of Silicon does not proliferate the mentioned effect and leads to a problem such as hot rolling embrittlement. Therefore, the concentration is controlled within an upper limit of 2.5%.

The content of the Aluminum is 0.03-1.5% in the present invention as Aluminum removes Oxygen existing in molten steel to prevent Oxygen from forming a gas phase and being boiled during a solidification process. Aluminum also fixes Nitrogen in the steel to form Aluminum-nitrides so as to reduce the size of the grains. Higher content of Aluminum above 1.5% increases $Ac_3$ point, thereby, increasing the necessary energy input for manufacturing the steel. Aluminum content between 1.0% and 1.5% can be used when high Manganese content is added in order to counterbalance the effect of Manganese on transformation points and Austenite formation evolution with temperature.

Chromium content of the steel of the present invention is between 0.05% and 1%. Chromium is an essential element that provides strength and hardening to the Steel but when used above 1% impairs surface finish of steel. Further Chromium contents under 1% coarsen the dispersion pattern of carbide in Bainitic structures, hence, keeping the density of Carbides in Bainite at low level.

Phosphorus constituent of the steel of the present invention is between 0.002% and 0.02%. Phosphorus reduces the spot weldability and the hot ductility, particularly due to its tendency to segregate at the grain boundaries or co-segregate with Manganese. For these reasons, its content is limited to 0.02% and preferably lower to Sulfur is not an essential element but may be contained as an impurity in steel and from point of view of the present invention the Sulfur content is preferably as low as possible, but is 0.003% or less from the viewpoint of manufacturing cost. Further if higher Sulfur is present in steel it combines to form Sulfides especially with Manganese and Titanium and reduces their beneficial impact on the present invention which can be detrimental for formability.

Niobium is present in the steel between 0.001% and 0.1% and suitable for forming carbo-nitrides to impart strength to the steel of the present invention by precipitation hardening. Niobium will also impact the size of microstructurel components through its precipitation as carbo-nitrides and by retarding the recrystallization during heating process. Thus finer microstructure formed at the end of the holding temperature and as a consequence after the complete annealing will lead to the hardening of the product. However, Niobium content above 0.1% is not economically interesting as a saturation effect of its influence is observed and this means that additional amount of Niobium does not result in any strength improvement of the product.

Titanium is an optional element which may be added to the steel of the present invention between 0.001% and 0.1%. Same as Niobium, it also forms carbo-nitrides precipitation, thus, plays a role in the strengthening of steel. But it is also forms Titanium-nitrides appearing during solidification of the cast product. The amount of Titanium is so limited to 0.1% to avoid coarse Titanium-nitrides detrimental for formability. In case the Titanium content is below 0.001% it does not impart any effect on the steel of the present invention.

Calcium is added in the steel of the present invention between 0.0001% and Calcium is added to the steel of the present invention as an optional element especially during the inclusion treatment. Calcium contributes towards the refining of the steel by arresting the detrimental Sulphur content in globular form, thereby, retarding the harmful effect of Sulphur.

Molybdenum is an optional element that constitutes 0.001% to 0.5% of the steel of the present invention; Molybdenum plays an effective role in determining hardenability and hardness, delays the appearance of Bainite and avoids carbides precipitation in Bainite. However, the addition of Molybdenum excessively increases the cost of the addition of alloying elements, so that for economic reasons its content is limited to 0.5%.

Copper may be added as an optional element in an amount of 0.01% to 2% to increase the strength of the steel and to improve its corrosion resistance. A minimum of 0.01% is required to get such effects. However, when its content is above 2%, it can degrade the surface aspect.

Nickel may be added as an optional element in an amount of 0.01% to 3% to increase the strength of the steel and to improve its toughness. A minimum of 0.01% is required to get such effects. However, when its content is above 3%, nickel causes ductility deterioration.

Nitrogen is limited to 0.01% in order to avoid ageing of material and to minimize the precipitation of Aluminum nitrides during solidification which are detrimental for mechanical properties of the steel.

Vanadium is effective in enhancing the strength of steel by forming carbides or carbo-nitrides and the upper limit is 0.1% from economic points of view. Other elements such as cerium, boron, magnesium or zirconium can be added individually or in combination in the following proportions: Cerium≤0.1%, Boron≤0.003%, Magnesium≤0.01% and Zirconium≤0.01% up to the maximum content levels indicated, these elements make it possible to refine the grain during solidification.

The remainder of the composition of the steel consists of iron and inevitable impurities resulting from processing.

The microstructure of the sheet claimed by the invention consists of the following.

Bainite constitutes 50% to 85% of microstructure by area fraction for the steel of the present invention. In the present invention the Bainite cumulatively consists of Lath Bainite and Granular Bainite, where Granular Bainite has a very low density of carbides, low density of carbides herein means the presence of carbide count to be less than or equal to 100 carbides per area unit of 100 $\mu m^2$ and having a high dislocation density which impart high strength as well as elongation to the Steel of present invention. The Lath Bainite is in the form of thin Ferrite laths with Austenite or carbides formed in between the laths. The Lath Bainite of steel of the present invention provides the steel with adequate formability. To ensure a total elongation of 14% and preferably 15% or more it is advantageous to have 50% of Bainite.

Residual Austenite content of the steel of the present invention is between 10% and 30% of microstructure by area fraction. Residual Austenite is known to have a higher solubility of Carbon than Bainite and, hence, acts as effective Carbon trap, therefore, retarding the formation of carbides in Bainite. Carbon percentage inside the Residual Austenite of the present invention is preferably higher than 0.9% and preferably lower than 1.1%. Residual Austenite of the steel according to the invention imparts an enhanced ductility.

Quenched Martensite constitutes 1% to 20% of microstructure by area fraction. Quench Martensite imparts strength to the present invention. Quenched Martensite is formed during the final cooling of the second annealing. No minimum is required but when Quenched Martensite is in excess of 20% it imparts excess strength but deteriorates other mechanical properties beyond acceptable limit.

Tempered Martensite constitutes 0% to 30% of microstructure by area fraction. Martensite can be formed when steel is cooled between $Tc_{min}$ and $Tc_{max}$ and is tempered during the overaging holding. Tempered Martensite imparts ductility and strength to the present invention. When Tempered Martensite is in excess of 30% it imparts excess strength but diminishes the elongation beyond acceptable limit. Further Tempered Martensite diminishes the gap in hardness of soft phases such as Residual Austenite and hard phases such as Quench Martensite.

In addition to the above-mentioned microstructure steel sheet may have ferrite which account for less than 5%, preferably less than 3%, in terms of area ratio and the microstructure is free from microstructural components, such as pearlite or cementite without impairing the mechanical properties of the steel sheets.

A steel sheet according to the invention can be produced by any suitable method. A preferred method consists in providing a semi-finished casting of steel with a chemical composition according to the invention. The casting can be done either into ingots or continuously in form of thin slabs or thin strips, i.e. with a thickness ranging from approximately 220 mm for slabs up to several tens of millimeters for thin strip.

For example, a slab having the above-described chemical composition is manufactured by continuous casting wherein the slab optionally underwent the direct soft reduction during the continuous casting process to avoid central segregation and to ensure a ratio of local carbon to nominal carbon kept below 1.10. The slab provided by continuous casting process can be used directly at a high temperature after the continuous casting or may be first cooled to room temperature and then reheated for hot rolling.

The temperature of the slab, which is subjected to hot rolling, is preferably at least 1200° C. and must be below 1280° C. In case the temperature of the slab is lower than 1200° C., excessive load is imposed on a rolling mill and, further, the temperature of the steel may decrease to a ferrite transformation temperature during finishing rolling, whereby the steel will be rolled in a state in which transformed ferrite contained in the structure. Therefore, the temperature of the slab is preferably sufficiently high so that hot rolling can be completed in the temperature range of Ac3 to Ac3+100° C. and final rolling temperature remains above Ac3. Reheating at temperatures above 1280° C. must be avoided because they are industrially expensive.

A final rolling temperature range between Ac3 to Ac3+100° C. is preferred to have a structure that is favorable to recrystallization and rolling. It is necessary to have final rolling pass to be performed at a temperature greater than Ac3, because below this temperature the steel sheet exhibits a significant drop in rollability. The sheet obtained in this manner is then cooled at a cooling rate above 30° C./s to the coiling temperature which must be below 600° C. Preferably, the cooling rate will be less than or equal to 200° C./s.

The hot rolled steel sheet is coiled at a coiling temperature below 600° C. to avoid ovalization of the hot rolled steel sheet and preferably below 570° C. to avoid scale formation. The preferable range of coiling temperature is between 350 and 570° C. The coiled hot rolled steel sheet is then cooled to room temperature before subjecting it to optional hot band annealing.

The hot rolled steel sheet may be subjected to an optional scale removal step to remove the scale formed during the hot rolling. The hot rolled sheet may then subjected to an optional Hot Band Annealing at temperatures between 400° C. and 750° C. for at least 12 hours and not more than 96 hours while keeping the temperature below 750° C. to avoid transforming partially the hot-rolled microstructure and, therefore, losing the microstructure homogeneity. Thereafter, optional scale removal step of this hot rolled steel sheet may be performed, for example such as pickling of such sheet. This hot rolled steel sheet is cold rolled with a thickness reduction between 35 to 90%. The cold rolled steel sheet obtained from cold rolling process is then subjected to two steps of annealing to impart the steel of present invention with microstructure and mechanical properties.

In first annealing, the cold rolled steel sheet is heated at a heating rate which is greater than 3° C./s, to a soaking temperature between Ac3 and Ac3+100° C. wherein Ac3 for the present steel is calculated by using the following formula:

$$Ac3=901-262*C-29*Mn+31*Si-12*Cr-155*Nb+86*Al$$

wherein the elements contents are expressed in weight percentage.

Then steel sheet is held at the soaking temperature during 10 seconds to 500 s to ensure a complete recrystallization and full transformation to Austenite of the strongly work hardened initial structure. The sheet is then cooled at a cooling rate greater than below 500° C. and preferably 400° C. Further it is preferred that cooling rate is greater than 30° C./s to ensure a single phase structure of Martensite.

Then the temperature of cold rolled steel sheet is brought to room temperature. The cold rolled annealed steel sheet may be optionally tempered between temperatures 120° C. and 250° C.

A second annealing of the cold rolled annealed steel sheet is performed by heating the annealed cold rolled steel sheet at a heating rate greater than 3° C./s, to a soaking temperature range between above Ac3 and Ac3+100° C. wherein Ac3 is calculated by using the formula Ac3=901−262*C−29*Mn+31*Si−12*Cr−155*Nb+86*Al during 10 seconds to 500 s to ensure 100% transformation to Austenite microstructure. The sheet is then cooled at a cooling rate greater than 20° C./s to a temperature range between $Tc_{min}$ and $Tc_{max}$ for a duration between 1 s and 10 s. These temperatures are calculated by using the proposed herein formula:

$$Tc_{max}=565-601*(1-Exp(-0.868*C))-34*Mn-13*Si-10*Cr+13*Al\ 361*Nb$$

$$Tc_{min}=535-601*(1-Exp(-0.868*C))-34*Mn-13*Si-10*Cr+13*Al\ 361*Nb$$

wherein the elements contents are expressed in weight percentage.

Thereafter, the cold rolled and annealed steel sheet is brought to a temperature range of 350° C. to 550° C. and kept there during 5 seconds to 500 seconds to ensure the formation of an adequate amount of Bainite as well as to temper the Martensite to impart the steel of present invention with targeted mechanical properties. Afterwards the cold rolled and annealed steel sheet is cooled down to room temperature with a cooling rate of at least 1° C./s or more to obtain cold rolled and heat treated steel sheet.

The cold rolled and heat treated steel sheet may undergo an additional optional heat treatment step to facilitate coating process, the said optional heat treatment step do not have any impact on the mechanical properties of the steel of present invention. The cold rolled steel sheet then may be optionally coated by any of the known industrial processes such as Electro-galvanization, JVD, PVD, Hot-dip(GI/GA) etc. The Electro-galvanization does not alter or modify any of the mechanical properties or microstructure of the steel sheet claimed. Electro-glavanization can be done by any conventional industrial process for instance by Electroplating.

The following tests, examples, figurative exemplification and tables which are presented herein are non-restricting in nature and must be considered for purposes of illustration only, and will display the advantageous features of the present invention.

Steel sheets made of steels with different compositions are gathered in Table 1, where the steel sheets are produced according to process parameters as stipulated in Table 2, respectively. The Table 3 gathers the microstructure of the steel sheets obtained during the trails and table 4 gathers result of evaluations of obtained properties.

TABLE 1

| | Steel Samples | | | | | | | | | | | | | | | |
|---|---|---|---|---|---|---|---|---|---|---|---|---|---|---|---|---|
| | C | Mn | Si | Al | S | P | N | Cr | Mo | Nb | Ti | Cu | Ni | Ca | V | B |
| 1 | 0.21 | 2.22 | 1.44 | 0.040 | 0.001 | 0.011 | 0.0060 | 0.212 | 0.002 | 0.002 | 0.0027 | 0.009 | 0.025 | 0.0018 | 0.004 | 0.0008 |
| 2 | 0.21 | 2.11 | 1.47 | 0.042 | 0.003 | 0.012 | 0.0038 | 0.367 | 0.002 | 0.001 | 0.0038 | 0.001 | 0.018 | 0.0008 | 0.003 | 0.0005 |
| 3 | 0.29 | 1.92 | 1.95 | 0.041 | 0.003 | 0.013 | 0.0040 | 0.060 | 0.001 | 0.002 | 0.0010 | 0.001 | 0.008 | 0.0005 | 0.001 | 0.0001 |

TABLE 1-continued

| | Steel Samples | | | | | | | | | | | | | | | |
|---|---|---|---|---|---|---|---|---|---|---|---|---|---|---|---|---|
| | C | Mn | Si | Al | S | P | N | Cr | Mo | Nb | Ti | Cu | Ni | Ca | V | B |
| 4 | 0.39 | 1.52 | 1.49 | 0.037 | 0.002 | 0.013 | 0.0040 | 0.07 | 0.001 | 0.055 | 0.0010 | 0.001 | 0.010 | 0.0004 | 0.001 | 0.0001 |
| 5 | 0.21 | 2.22 | 1.44 | 0.040 | 0.001 | 0.011 | 0.0060 | 0.212 | 0.002 | 0.002 | 0.0027 | 0.009 | 0.025 | 0.0018 | 0.004 | 0.0008 |
| 6 | 0.21 | 2.11 | 1.47 | 0.042 | 0.003 | 0.012 | 0.0038 | 0.367 | 0.002 | 0.001 | 0.0038 | 0.001 | 0.018 | 0.008 | 0.003 | 0.0005 |
| 7 | 0.29 | 1.92 | 1.95 | 0.041 | 0.003 | 0.013 | 0.0040 | 0.060 | 0.001 | 0.002 | 0.0010 | 0.001 | 0.008 | 0.0005 | 0.001 | 0.0001 |
| 8 | 0.39 | 1.52 | 1.49 | 0.037 | 0.002 | 0.013 | 0.0040 | 0.070 | 0.001 | 0.055 | 0.0010 | 0.001 | 0.010 | 0.0004 | 0.001 | 0.0001 |

Table 2 gathers the annealing process parameters implemented on steels of Table 1. The Steel compositions 11 to 13 serve for the manufacture of sheets according to the invention. This table also specifies the reference steel compositions which are designated in table from R1 to R3. Table 2 also shows tabulation of $Tc_{min}$ and $Tc_{max}$ temperatures of inventive steel and reference steel. $Tc_{min}$ and $Tc_{max}$ are calculated by using the following formula:

$$Tc_{max}=565-601*(1-Exp(-0.868*C))-34*Mn-13*Si-10*Cr+13*Al\ 361*Nb$$

$$TC_{min}=535-601*(1-Exp(-0.868*C))-34*Mn-13*Si-10*Cr+13*Al\ 361*Nb$$

Further, before performing the annealing treatment on the steels of invention as well as on the reference ones, the Steels were heated to a temperature between 1000° C. and 1280° C. and then subjected to hot rolling with finish temperature above 850° C. and thereafter were coiled at a temperature below 600° C. The Hot rolled coils were then processed as claimed and thereafter cold rolled with a thickness reduction between 30 to 95%. These cold rolled steel sheets were subjected to heat treatments as enumerated in Table 2 herein:

TABLE 2

| | | | | | First Annealing | | | Second Annealing | |
|---|---|---|---|---|---|---|---|---|---|
| Trials | Steel | Reheating T (° C.) | Hot roll finishing T (° C.) | Hot roll Coiling T (° C.) | Soaking T (° C.) | Soaking t (s) | Cooling rate (° C./s) | Soaking T (° C.) | Soaking t (s) |
| I1 | 1 | 1220 | 937 | 546 | 870 | 80 | 1000 | 880 | 80 |
| I2 | 2 | 1250 | 910 | 450 | 870 | 80 | 1000 | 860 | 80 |
| I3 | 3 | 1250 | 880 | 450 | 850 | 120 | 1000 | 840 | 100 |
| I4 | 4 | 1246 | 904 | 551 | 820 | 120 | 100 | 820 | 100 |
| R1 | 5 | 1220 | 937 | 546 | 870 | 80 | 1000 | 860 | 80 |
| R2 | 6 | 1250 | 910 | 450 | 870 | 80 | 1000 | 860 | 80 |
| R3 | 7 | 1250 | 880 | 450 | X | X | X | 850 | 100 |
| R4 | 8 | 1246 | 904 | 551 | 820 | 120 | 1000 | 820 | 100 |

| | Second Annealing | | | | | |
|---|---|---|---|---|---|---|
| Trials | Cooling stop temperature (° C.) | Holding T (° C.) | Holding t (s) | Ac3 (° C.) | $Tc_{max}$ (° C.) | $Tc_{min}$ (° C.) |
| I1 | 350 | 460 | 15 | 828 | 370 | 340 |
| I2 | 350 | 460 | 15 | 830 | 372 | 342 |
| I3 | 320 | 400 | 15 | 831 | 338 | 308 |
| I4 | 290 | 400 | 200 | 795 | 351 | 271 |
| R1 | 320 | 460 | 15 | 828 | 370 | 340 |
| R2 | 330 | 400 | 200 | 830 | 372 | 342 |
| R3 | 220 | 460 | 50 | 831 | 388 | 308 |
| R4 | 120 | 400 | 200 | 795 | 301 | 271 |

I = according to the invention;
R = reference;
underlined values: not according to the invention.

Table 3 exemplifies the results of test conducted in accordance of standards on different microscopes such as Scanning Electron Microscope for determining microstructural composition of both the inventive steel and reference steel.

The results are stipulated herein:

TABLE 3

| Steel Sample | Bainite | Residual Austenite | Tempered Martensite | Quenched Martensite | Bainite + Residual Austenite |
|---|---|---|---|---|---|
| I1 | 68 | 12 | 7 | 13 | 80 |
| I2 | 58 | 14 | 17 | 11 | 72 |
| I3 | 59 | 15 | 12 | 14 | 74 |
| I4 | 74 | 14 | 0 | 12 | 88 |
| R1 | 43 | 12 | 31 | 14 | 55 |
| R2 | 37 | 10 | 37 | 16 | 47 |
| R3 | 0 | 9 | 80 | 11 | 9 |
| R4 | 17 | 10 | 63 | 10 | 27 |

I = according to the invention; R = reference; underlined values: not according to the invention.

Table 4 exemplifies the mechanical properties of both the inventive steel and reference steel. The tensile strength, yield strength and total elongation test are conducted in accordance of JIS Z2241 standards.

Henceforth the outcome of the various mechanical tests conducted in accordance to the standards is tabulated:

TABLE 4

| Sample Steels | Tensile Strength(in MPa) | Yield Strength (in MPa) | YS/TS | Total Elongation(in %) |
|---|---|---|---|---|
| I1 | 1245 | 850 | 0.68 | 15 |
| I2 | 1264 | 900 | 0.71 | 14.3 |
| I3 | 1347 | 1231 | 0.91 | 18.4 |
| I4 | 1437 | 1025 | 0.71 | 14.9 |
| R1 | 1237 | 925 | 0.75 | 13.7 |
| R2 | 1250 | 1008 | 0.81 | 13.1 |
| R3 | 1331 | 1186 | 0.89 | 11.7 |
| R4 | 1446 | 1355 | 0.94 | 13.4 |

I = according to the invention; R = reference; underlined values: not according to the invention.

What is claimed is:

1. A cold rolled heat treated steel sheet having a composition comprising the following elements, expressed in percentage by weight:

0.1%≤Carbon≤0.5%
1%≤Manganese≤3.4%
0.5%≤Silicon≤2.5%
0.03%≤Aluminum≤1.5%
0%≤Sulfur≤0.003%,
0.002%≤Phosphorus≤0.02%
0%≤Nitrogen≤0.01%
and optionally containing one or more of the following elements
0.05%≤Chromium≤1%
0.001%≤Molybdenum≤0.5%
0.001%≤Niobium≤0.1%
0.001%≤Titanium≤0.1%
0.01%≤Copper≤2%
0.01%≤Nickel≤3%
0.0001%≤Calcium≤0.005%
0%≤Vanadium≤0.1%
0%≤Boron≤0.003%
0%≤Cerium≤0.1%
0%≤Magnesium≤0.010%
0%≤Zirconium≤0.010%
a remainder being iron and unavoidable impurities caused by processing;
a microstructure of the cold rolled heat treated steel sheet comprising in area fraction, 10 to 30% Residual Austenite, 50 to 85% Bainite, 1 to 20% Quenched Martensite, and less than 30% Tempered Martensite, the Bainite consisting of Lath Bainite and Granular Bainite.

2. The cold rolled heat treated steel sheet as recited in claim 1 wherein the composition includes 0.7% to 2.4% of Silicon.

3. The cold rolled heat treated steel sheet as recited in claim 1 wherein the composition includes 0.03% to 0.9% of Aluminum.

4. The cold rolled heat treated steel sheet as recited in claim 3 wherein the composition includes 0.03% to 0.6% of Aluminum.

5. The cold rolled heat treated steel sheet as recited in claim 1 wherein the composition includes 1.2% to 2.3% of Manganese.

6. The cold rolled heat treated steel sheet as recited in claim 1 wherein the composition includes 0.03% to 0.5% of Chromium.

7. The cold rolled heat treated steel sheet as recited in claim 1 wherein a sum of the Bainite and the Residual Austenite is equal to 70% or more.

8. The cold rolled heat treated steel sheet as recited in claim 1 wherein a sum of the Tempered Martensite, and the Quenched Martensite is more than or equal to 20% and the Quenched Martensite is higher than 10%.

9. The cold rolled heat treated steel sheet as recited in claim 1 wherein the cold rolled heat treated steel sheet has an ultimate tensile strength 1100 MPa, and a total elongation 14.0% or more.

10. The cold rolled heat treated steel sheet as recited in claim 9 wherein a yield strength to ultimate tensile strength ratio is greater than or equal to 0.65.

11. The cold rolled heat treated steel according to claim 1, wherein said composition includes, in percentage by weight: 1.2%≤Manganese≤2.2%.

12. The cold rolled heat treated steel according to claim 1, wherein said microstructure includes, in area fraction, less than 3% ferrite.

13. A method of production of the cold rolled heat treated steel sheet as recited in claim 1 comprising the following successive steps:

providing semi-finished product having a steel composition comprising the following elements, expressed in percentage by weight:
0.1%<Carbon<0.5%
1%<Manganese<3.4%
0.5%<Silicon<2.5%
0.03%<Aluminum<1.5%
0%<Sulfur<0.003%
0.002%<Phosphorus<0.02%
0%<Nitrogen<0.01%
and optionally containing one or more of the following elements
0.05%<Chromium<1%
0.001%<Molybdenum<0.5%
0.001%<Niobium<0.1%
0.001%<Titanium<0.1%
0.01%<Copper<2%
0.01%<Nickel<3%
0.001%<Calcium<0.005%
0%<Vanadium<0.1%
0%<Boron<0.003%
0%<Cerium<0.1%
0%<Magnesium<0.010%
0%<Zirconium<0.010%
a remainder being iron and unavoidable impurities caused by processing;
reheating the semi-finished product to a temperature between 1200° C. and 1280° C.;
rolling the semi-finished product in an austenitic range wherein the hot rolling finishing temperature is above Ac3 to obtain a hot rolled steel sheet;
cooling the hot rolled steel sheet at a cooling rate above 30° C./s to a coiling temperature below 600° C. and coiling the hot rolled steel sheet;
cooling the hot rolled steel sheet to room temperature;
optionally performing a scale removal process on the hot rolled steel sheet;
optionally annealing the hot rolled steel sheet at temperature between 400° C. and 750° C.;
optionally performing a scale removal process on the hot rolled steel sheet;
cold rolling the hot rolled steel sheet with a reduction rate between 35 and 90% to obtain a cold rolled steel sheet;

heating the cold rolled steel sheet at a rate greater than 3° C./s to a soaking temperature between Ac3 and Ac3+100° C. and holding the cold rolled steel sheet for a time of 10 to 500 seconds;

cooling the cold rolled steel sheet at a rate greater than 20° C./s to a temperature below 500° C. to define an annealed cold rolled steel sheet;

cooling the annealed cold rolled steel sheet to room temperature;

optionally tempering the annealed cold rolled steel sheet between 120° C. and 250° C.;

heating the annealed cold rolled steel sheet at a rate greater than 3° C./s to a soaking temperature between Ac3 and Ac3+100° C. and holding the annealed cold rolled steel sheet of 10 to 500 seconds;

cooling the annealed cold rolled steel sheet at a rate greater than 20° C./s to a temperature range between $T_{Cmax}$ and $T_{Cmin}$ wherein:

$$T_{Cmax}=565-601*(1-Exp(-0.868*C))-34*Mn-13*Si-10*Cr+13*Al-361*Nb$$

$$T_{Cmin}=535-601*(1-Exp(-0.868*C))-34*Mn-13*Si-10*Cr+13*AI-361*Nb; \text{ and}$$

bringing the annealed cold rolled steel sheet to a holding temperature range between 350° C. and 550° C. for a time period between 5 and 500 seconds and then cooling the annealed cold rolled steel sheet to room temperature with a cooling rate of at least 1° C./s to obtain the cold rolled heat treated steel sheet; and optionally coating the cold rolled heat treated steel sheet;

thereby producing the cold rolled heat treated steel sheet of claim 1.

14. The method as recited in claim 13 wherein the coiling temperature is below 570° C.

15. The method as recited in claim 13 wherein the soaking temperature for first or second annealing is between Ac3 and Ac3+50° C.

16. The method as recited in claim 13 wherein the cooling of the cold rolled steel sheet or the cooling of the annealed cold rolled steel sheet is greater than to a temperature below 500° C.

17. A structural or safety part of a vehicle made according to the method as recited in claim 13.

18. The part as recited in claim 17 wherein the part is obtained by flexible rolling of the cold rolled heat treated steel sheet.

19. A vehicle comprising the part as recited in claim 17.

20. A structural or safety part of a vehicle comprising the cold rolled and heat treated steel sheet as recited in claim 1.

21. The part as recited in claim 20 wherein the part is obtained by flexible rolling of the cold rolled and heat treated steel sheet.

22. A vehicle comprising the part as recited in claim 20.

* * * * *